United States Patent [19]

Matsui et al.

[11] 3,934,931

[45] Jan. 27, 1976

[54] DENTAL CHAIR

[75] Inventors: Takahiro Matsui; Osamu Uwamori, both of Kyoto, Japan

[73] Assignee: Kabushiki Kaisha Morita Seisakusho, Kyoto, Japan

[22] Filed: Apr. 5, 1974

[21] Appl. No.: 458,223

[30] Foreign Application Priority Data

Apr. 17, 1973 Japan ..... 48-43370

[52] U.S. Cl. ..... 297/319; 297/71; 297/90; 297/354; 297/423

[51] Int. Cl.[2] ..... A61G 15/00; A47C 16/02

[58] Field of Search ..... 297/319, 321, 339, 316, 297/317, 355, 320, 322, 323, 313, 423, 68, 90, 91, 85, 71, 311; 5/68, 79, 80, 74

[56] References Cited

UNITED STATES PATENTS

| | | | |
|---|---|---|---|
| 847,880 | 3/1907 | Barker et al. | 297/319 |
| 1,287,958 | 12/1918 | Giberson | 297/68 |
| 2,136,852 | 11/1938 | Knauth | 297/316 |
| 2,535,687 | 12/1950 | Lorenz | 297/319 |
| 2,760,559 | 8/1956 | Austin | 297/320 X |
| 3,284,135 | 11/1966 | Hiramatsu | 297/361 |
| 3,330,595 | 7/1967 | Svärd | 297/316 X |
| 3,381,997 | 5/1968 | Fritz et al. | 297/319 |
| 3,427,072 | 2/1969 | Hale | 297/316 X |

FOREIGN PATENTS OR APPLICATIONS

| | | | |
|---|---|---|---|
| 1,164,434 | 5/1958 | France | 297/319 |

*Primary Examiner*—James T. McCall
*Attorney, Agent, or Firm*—Christensen, O'Connor, Garrison & Havelka

[57] ABSTRACT

A dental chair which comprises a seat, a back inclinable relative to said seat, first means for effecting inclination of said back, second means for pushing the front portion of said seat upward, and third means operable in response to overinclination of said back beyond the normal inclination thereof to drive said second means so as to raise the front portion of said seat relative to the rear portion thereof.

7 Claims, 5 Drawing Figures

DENTAL CHAIR

This invention relates to a dental chair of such a type that the inclination of the chair back relative to the chair seat is adjustable.

The dental chair of the type with which the present invention is concerned is provided with a base, a seat vertically movable relative to the base and a back attached to the seat so as to be inclinable relative to the seat. When a patient undergoes dental treatment, he is seated in the chair with his back leaning against the back of the chair. In order to bring the mouth of the patient to a position most suitable and convenient for the treatment, the chair seat is raised or lowered and the chair back is adjusted to a proper inclination relative to the chair seat.

In some cases, the chair back is lowered to a horizontal position so that the patient lies flat on the chair back and seat.

Experience shows that while a treatment of, say, pulling out a tooth is being conducted, the patient sometimes becomes temporarily anemic. In such an emergency the patient's head must be lowered below the level of his heart. To this end, the chair seat may be so inclined that the position of the patient's knees is higher than that of his waist and the chair back is so inclined beyond the horizontal line that the patient's head is positioned below his waist.

However, in the prior art chairs besides the mechanism for changing the inclination of the chair back for normal treatment there was provided a separate mechanism for effecting the above movements of the seat and the back of the chair. The separate mechanism is such as to rotate the chair back about the pivot thereof to the chair seat so as to "overincline" the chair back relative to the chair seat. However, if under the normal condition when the seat is raised above the horizontal line, such an emergency as was previously mentioned occurs the chair back must first be lowered or inclined to a substantially horizontal position by operating the usual mechanism provided for the purpose, and then the additional mechanism for over-inclination of the chair back is operated, or alternatively the additional mechanism is first operated and then the usual mechanism is operated to incline the chair back.

Thus, in the prior art dental chairs, the operation in case of emergency is doubled and troublesome, with structural complication caused by the provision of the mechanism for normal adjustment of the inclination of the chair back and the additional mechanism for overinclination thereof in emergency cases such as previously mentioned.

Accordingly, the principal object of the invention is to provide a dental chair the operation of which is much simplified in an emergency.

Another object of the invention is to provide a dental chair in which the operation for overinclination of the chair back in case of emergency causes the chair seat to be tilted.

Another object of the invention is to provide a dental chair in which the motion of the chair back for overinclination in case of emergency is utilized to effect tilting of the chair seat.

Another object of the invention is to provide a dental chair in which the drive for inclination of the chair back is used also for tilting of the chair seat.

Another object of the invention is to provide a dental chair in which the tilting of the chair seat is initiated in ganged relation to the motion of overinclination of the chair back.

Still another object of the invention is to provide a dental chair in which the chair back and seat can be quickly brought to a position suitable for meeting a state of emergency.

The dental chair of the invention has a chair back which is inclinable about a point near the crossing point of the back and the seat. So long as the chair back is adjusted within the normal range of inclination, no tilting or inclination of the chair seat occurs.

However, when the chair back is "overinclined", that is, inclined beyond the normal range of inclination, the chair seat is also turned or tilted. In one embodiment of the invention, the lower end portion of the chair back is utilized for operation of the seat tilting mechanism. That is, when the chair back is overinclined, the displacement of the lower end of the chair back actuates the seat tilting mechanism. The mechanism includes a linkage which is actuated by the above displacement of the chair back to raise a push rod so that the rod pushes the chair seat upward thereby tilting the seat. The linkage may include a gearing, but without use of any gears it is possible to raise the push rod for tilting of the chair seat.

A single drive for inclination of the chair back suffices and no other particular drive for tilting of the chair seat is required. Since the tilting of the seat is effected by the movement of over-inclination of the chair back, the operation is very simple. Furthermore, it is not necessary to integrate the seat and the back as was the case with the prior art chairs of this type, nor is it necessary to provide any additional mechanism and drive for operating such integrated components of the chair.

The invention will be described in detail with reference to the accompanying drawings, wherein.

Figure 1:
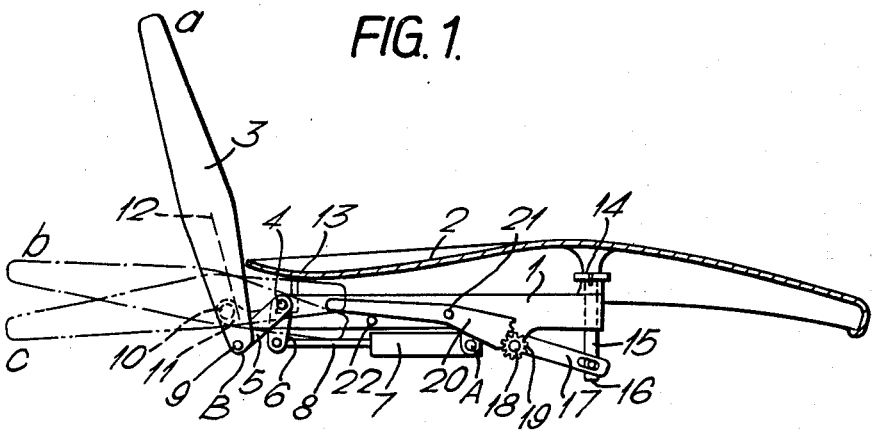
FIG. 1 is a side view, partly in section, of the chair of the invention.

Referring to the drawings, there is shown a seat frame 1 which is vertically movable relative to a base, not shown, by any suitable known drive. A seat 2 is mounted on the seat frame, with a chair back 3 arranged at the rear side (or left-hand side in the drawing figures) of the seat 2. A shaft 4 is rotatably carried by the seat frame 1 and levers 5 and 6 are secured to the shaft.

A drive 7 for effecting the inclination of the chair back 3 is provided beneath the seat frame 1. The drive rotates the lever 6 to turn about the axis of the shaft 4. The drive may be electric or hydraulic. In the illustrated embodiment the drive 7 is an oil-pressure cylinder. The cylinder 7 has its rear end pivoted to the seat frame 1 by means of a pin A.

The cylinder 7 has a piston rod 8 which is axially reciprocable by the operation of the cylinder in the well-known manner. The outer end of the rod 8 is pivotably connected to the lever 6. As the rod 8 is reciprocated, the lever 6 is rotated about the axis of the shaft 4, so that the shaft 4 is rotated. This in turn rotates the lever 5 fixed to the shaft 4.

The outer end of the lever 5 is pivotally connected by a pin 9 to the lower end of the chair back. Therefore, when the lever 5 is turned, the chair back is raised or lowered depending upon the direction of turning of the lever 5.

The seat frame 1 has a rearwardly projecting arm 11 having a roller 10 at the outer end thereof. The arm 11 and the roller 10 support the chair back 3 at the back side thereof. The chair back 3 is provided with a guide surface or rail 12 on which the roller 10 abuts. The inclination of the chair back 3 therefore depends on the direction of the straight line connecting the centers of the roller 10 and the pivot pin 9. Since the position of the center of the pin 9 is changed by the turning of the lever 5 about the axis of the shaft 4, the inclination of the chair back is changed by turning the lever 5.

In FIG. 1, when the shaft 4 is rotated counter-clockwise, the line connecting the roller 10 and the pin 9 approaches a horizontal position, that is, comes to lie more and more horizontal, so that the chair back 3 is inclined toward a horizontal position.

In order to raise the chair back toward its upright position, the shaft 4 is simply rotated clockwise. Thus, by operating the cylinder 7 it is possible to selectively change the inclination of the chair back relative to the seat. The mechanism is disclosed in U.S. Pat. No. 3,284,135 issued on Nov. 18, 1966.

For inclination or tilting of the chair seat 2 a bracket 13 has its upper end fixed to the under side of the rear end (left-hand end) of the seat 2 and bifurcated to engage with the shaft 4. It is preferred that the bracket 13 be as near the chair back as possible.

A seat tilting mechanism is provided beneath the seat 2 at the middle of the length thereof. The mechanism includes a pin 14 downwardly projecting from the underside of the seat 2 and a vertical push rod 15 axially slidably supported by the seat frame 1. The rod has formed in its upper end face a hole in which the pin 14 is loosely engaged. When the rod 15 is moved upward in the manner to be described later, the seat is pushed upward at about the middle portion thereof and since the seat has its rear (left-hand) end connected to the shaft 4 through the bracket 13, the seat is turned or tilted counterclockwise about the shaft 4, so that the patient seated on the seat has his knees raised higher than his waist.

The seat tilting mechanism further includes a linkage which comprises a link lever 20 pivoted to the seat frame 1 by a pin 21. The counterclockwise rotation of the lever 20 is limited by a stop pin 22 fixed to the seat frame 1. The lever has its one end (right-hand end) formed into a sector gear 20A having the center of the sector at the pin 21.

The gear 20A meshes with a pinion gear 19 fixed to a shaft 18 journalled on the seat frame 1. The shaft 18 is in turn fixed to one end of a link 17. In the opposite end of the link 17 there is formed a slot 17A in which a pin 16 fixed to the push rod 15 engages.

Figure 1A:
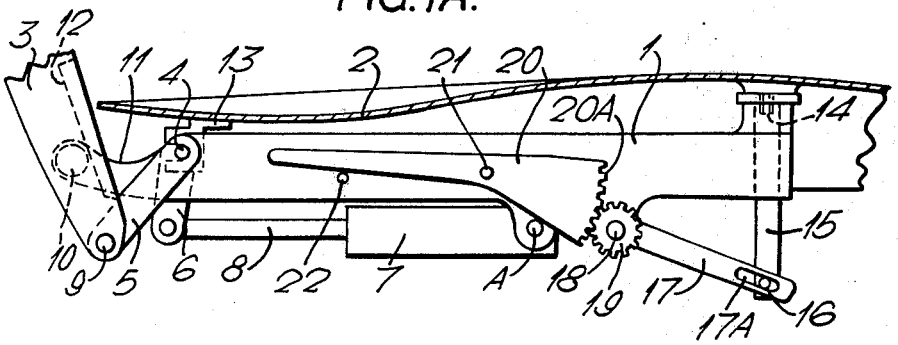
FIG. 1A is an enlarged section of a portion of FIG. 1.

In FIGS. 1 and 1A, if the lever 20 is turned clockwise about the pin 21, the pinion 19 meshing with the sector gear 20A is rotated counterclockwise and consequently the link 17 fixed to the pinion 19 is turned in the same direction, thereby moving the push rod 15 upwardly.

Figure 2:
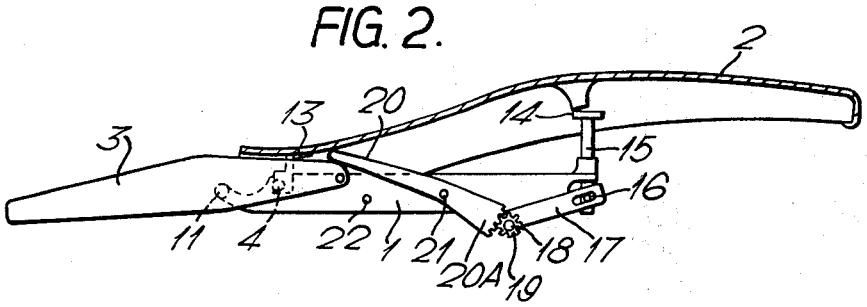
FIG. 2 is a view similar to FIG. 1 but showing the chair back in the state of overinclination, with some of the parts removed for simplicity of illustration.

The turning of the lever 20 about the pin 21 is effected by engagement of the lower end of the chair back with the free (left-hand) end of the lever 20. In FIG. 1 the chair back is shown by real lines at its upright position *a*. For normal treatment the chair back is adjusted between the upright position *a* and the normal lowest position *b* shown by dotted lines. When an emergency has occurred, the chair back is further inclined by the cylinder 7 from the position *b* beyond the horizontal line to a position *c* shown by dot-and-dash lines. Before the chair back reaches the overinclined position *c*, the lower end of the chair back hits on the free end of lever 20, and upon further movement of the chair back the lever 20 turns clockwise about the pin 21 as shown in FIG. 2. From this figure it is clear that after the chair back is overinclined beyond the horizontal line, the chair seat 2 is tilted as its forward or right-hand portion is pushed upward, so that the patient seated on the chair with his back leaning against the chair back will have his head positioned below his heart.

In order to restore the chair back from the position of FIG. 2 to the normal position, the chair back is turned in the opposite direction, that is, clockwise. As the chair back is turned, the lower end of the chair back is released from the lever 20, thereby eliminating the pushing force of the rod 15, whereupon the weight of the patient on the chair causes the rod 15 to move downwardly, thereby causing the lever 20 to rotate counterclockwise about the pin 21 till the lever is stopped by the pin 22. If it is desirable to smooth the restoration of the lever 20, a spring may be provided to bias the lever counterclockwise.

Figure 3:
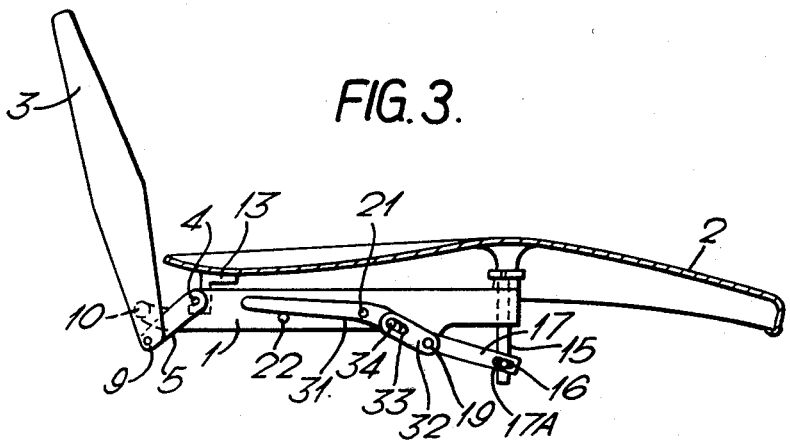
FIG. 3 is a view similar to FIG. 1 but showing another embodiment of the invention.
Figure 3A:
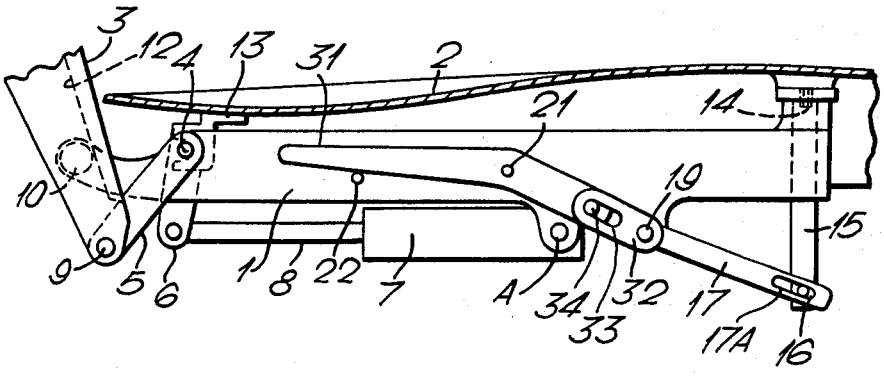
FIG. 3A is an enlarged sectional view of a portion of FIG. 3.

FIGS. 3 and 3A show another form of the mechanism for pushing the rod 15 upward. No pinion gear similar to 19 of FIG. 1 is used in this embodiment. A link lever 31 has one end adapted to be engaged by the lower end of the chair back as shown in FIG. 1, and the opposite end of the lever is provided with a pin 34. To the shaft 18 journalled on the chair frame 1 a link 32 is fixed as well as the link 17. The link 32 is formed with a slot 33 in which the pin 34 on the lever 32 is slidably engaged. The link 17 is formed with a slot 17A in which the pin 16 fixed to the rod 15 is engaged just as in the embodiment of FIG. 1.

When the chair back 3 is overinclined so as to rotate the lever 31 clockwise about the pin 21, the lever 31 rotates the shaft 18 counterclockwise through the link 32, so that the link 17 is turned in the same direction to push the rod 15 upward, thereby causing the seat 2 to be tilted counterclockwise about the shaft 4 to a tilted position as shown in FIG. 2.

What we claim is:

1. A dental chair, comprising:

a generally horizontally positioned seat having front and rear portions;

a back positioned adjacent said rear portion of said seat and movable to various inclines relative to said seat between a first, substantially upright, position and a second position below the horizontal;

first means for effecting inclination of said back between said first and second positions;

second means for pushing said front portion of said seat upward relative to said rear portion thereof; and third means operable only in response to inclination of said back below a substantially horizontal position to drive said second means, resulting in said front portion of said seat being pushed upward relative to said rear portion thereof, such that the knees of a patient using the dental chair are raised above his waist.

2. The dental chair of claim 1, including means fixing the vertical position of said rear portion of said seat so that the front portion thereof may be pushed upwardly relative to said rear portion by said second means, thereby tilting said front portion of said seat about said means fixing the vertical position of said rear portion thereof.

3. The dental chair of claim 2, wherein said back has upper and lower ends, said lower end initiating operation of said third means by contact therewith when said back is substantially horizontal, said third means continuing in operation so as to drive said second means as said back is further inclined below the horizontal, whereby said front portion of said seat is pushed upwardly relative to said rear portion thereof.

4. The dental chair of claim 3, wherein said third means includes a link lever having a seat back engaging end thereof positioned in the path of travel of said lower end of said back as said back is moved between said first and second positions.

5. The dental chair of claim 4, wherein the other end of said link lever is rotated about a pivot point as said seat back engaging end of said link lever is rotated by said lower end of said back, and wherein said second means includes means converting the rotation of the other end of said first link lever into lineal drive motion to drive said second means.

6. The dental chair of claim 5, wherein the other end of said first link lever forms a sector gear, and wherein said converting means includes a second link lever, one end of which has a pinion gear secured thereto, said second link lever being mounted so that said pinion gear meshes with said sector gear, thereby rotating the other end of said second link lever about said one end thereof, said other end of said second link lever having a slot defined therein, and wherein said second means includes a push rod having two ends and supported for vertical travel, one end of said push rod contacting said seat, and the other end of said push rod having a pin extending therefrom adapted for slidable engagement in said slot, such that rotation of the other end of said second link lever results in an upward force on said pin, causing said push rod and hence said front portion of said seat to be pushed upwardly, tilting said front portion of said seat about said means fixing the vertical position of the rear portion thereof.

7. The dental chair of claim 5, wherein said converting means includes a second link lever having two ends and mounted so as to be pivotable about a point therebetween, each of said two ends having defined therein a slot, and wherein the other end of said first link lever includes a first pin extending therefrom adapted for slidable engagement in the slot defined in one end of said second link lever, said second means including a push rod having two ends and supported for vertical travel, said one end of said push rod contacting said seat, and the other end of said push rod having a second pin extending therefrom adapted for slidable engagement in the slot defined in the other end of said second link lever and, wherein rotation of the other end of said first link lever results in rotation of the other end of said second link lever and an upward force on said second pin, causing said push rod and hence said front portion of said seat to be pushed upwardly.

* * * * *